US008256083B2

(12) United States Patent
Huang

(10) Patent No.: US 8,256,083 B2
(45) **Date of Patent: *Sep. 4, 2012**

(54) DEVICE FOR ASSEMBLING AND DISASSEMBLING A BICYCLE CHAIN

(76) Inventor: Hung-Chen Huang, Chang Hwa (TW)

( * ) Notice: Subject to any disclaimer, the term of this patent is extended or adjusted under 35 U.S.C. 154(b) by 392 days.

This patent is subject to a terminal disclaimer.

(21) Appl. No.: 12/688,891

(22) Filed: Jan. 17, 2010

(65) Prior Publication Data

US 2011/0047769 A1 Mar. 3, 2011

(30) Foreign Application Priority Data

Aug. 27, 2009 (TW) ..... 98128829 A

(51) Int. Cl.
*B25B 27/00* (2006.01)

(52) U.S. Cl. ..... 29/270; 29/243

(58) Field of Classification Search ..... 29/270, 29/243, 53, 243.54; 59/7, 11
See application file for complete search history.

(56) References Cited

U.S. PATENT DOCUMENTS 4,949,446 A * 8/1990 Kuwica ..... 29/243.53
5,140,736 A * 8/1992 Hsiao ..... 29/243.54
8,136,338 B2 * 3/2012 Huang ..... 59/7

* cited by examiner

*Primary Examiner* — Basil Katcheves

(57) ABSTRACT

A device for assembling and disassembling a bicycle chain comprises a mounting seat, an actuating member, an assembling member, a rod member, a spring, and a pulling member. The rod member, the pulling member and the spring are connected to one another to guide a positioning member to be assembled into the assembling holes in a balance manner, so that the device for assembling and disassembling a bicycle chain makes the assembly of the chain more convenient and simple.

6 Claims, 9 Drawing Sheets

DEVICE FOR ASSEMBLING AND DISASSEMBLING A BICYCLE CHAIN

BACKGROUND OF THE INVENTION

1. Field of the Invention

The present invention relates to a device for assembling and disassembling a chain, and more particularly to a device for assembling and disassembling a bicycle chain.

2. Description of the Prior Art

Referring to FIG. 1, a conventional device for assembling and disassembling a bicycle chain disclosed in Taiwan Patent No. 96132305 comprises a mounting seat 11, an actuating member 12, a guiding push member 13 and a handle 14.

When the above device for assembling and disassembling a bicycle chain needs to assemble two chains A, the two chains A will be straddled over a positioning protrusion 111 of the mounting seat 11 first, and then the guiding push member 13 will be inserted through a through hole 112 of the mounting seat 11 in such a manner that a guiding portion 131 of the guiding push member 13 is inserted through the assembling holes A1 of the two chains A one by one and positioned therein, subsequently, a positioning member B will be placed between the guiding portion 131 of the guiding push member 13 and a pushing portion 121 of the actuating member 12, and after that, the user will hold the handle 14 with one hand and rotate the actuating member 12 with the other to make the pushing portion 121 push against the positioning member B to force the guiding push member 13 to slide, and finally, the positioning member B will be inserted into the assembling holes A1 of the two chains A. However, this conventional device for assembling and disassembling a bicycle chain still suffers from the following defects:

When the two chains A are assembled, both ends of the positioning member B abut against the pushing portion 121 of the actuating member 12 and the guiding portion 131 of the guiding push member 13, since the guiding push member 13 is only used to be inserted into the through hole 112 of the mounting seat 11 and can freely move but cannot apply a pushing force to pre-position the positioning member B, when assembling the two chains A, the user has to hold the handle 14 or the mounting seat 11 and rotate the actuating member 12 synchronously besides balancing the positioning member B with one hand. Therefore, the above conventional device is inconvenient to use, and thus improvements are indeed needed.

The present invention has arisen to mitigate and/or obviate the afore-described disadvantages.

SUMMARY OF THE INVENTION

The primary object of the present invention is to provide a device for assembling and disassembling a bicycle chain which utilizes a spring to guide a positioning member to be assembled into the assembling holes of two chains in a balance manner to make the assembly of the bicycle chain more convenient and simple.

A device for assembling and disassembling a bicycle chain in accordance with the present invention comprises: a mounting seat, an actuating member, an assembling member, a rod member, a spring, and a pulling member. The mounting seat includes a threaded hole, an assembling hole and an assembling space between the threaded hole and the assembling hole. The actuating member is screwed in the threaded hole of the mounting seat. The assembling member is provided with an inserting hole and an assembling portion formed at one end of the inserting hole, and at another end of the inserting hole is formed an annular flange. The rod member is inserted in the inserting hole of the assembling member and has a guiding portion formed at one end thereof, and the guiding portion is inserted in the inserting hole of the assembling member or the assembling space in such a manner that another end of the rod member extends out of the inserting hole of the assembling member, and between the another end of the rod member and the guiding portion is formed a limiting portion. The spring is mounted on the rod member in such a manner that both ends of the spring are abutted against the limiting portion of the rod member and the annular flange of the assembling member. The pulling member is disposed at another end of the rod member and rested against one end of the inserting hole of the assembling member.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
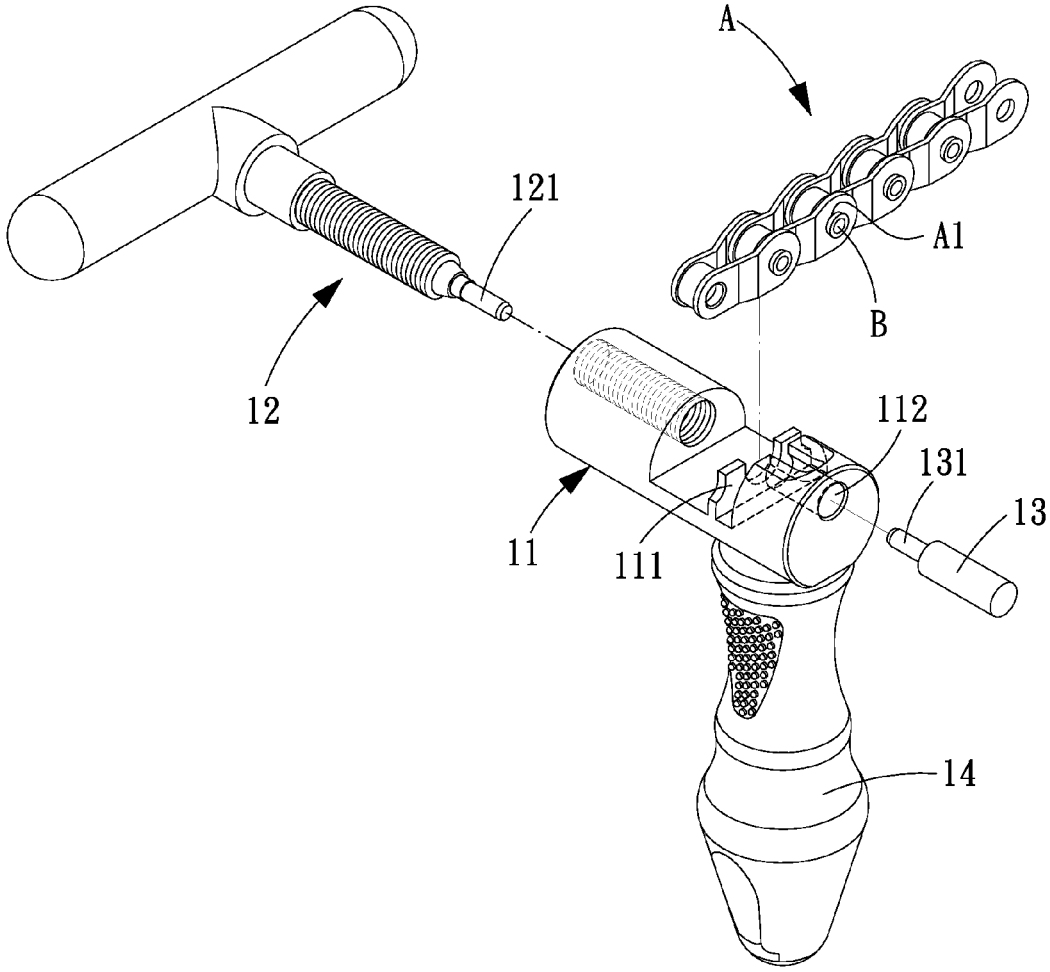
FIG. 1 PRIOR ART
FIG. 1 is a perspective view of a conventional device for assembling and disassembling a bicycle chain.
Figure 2:
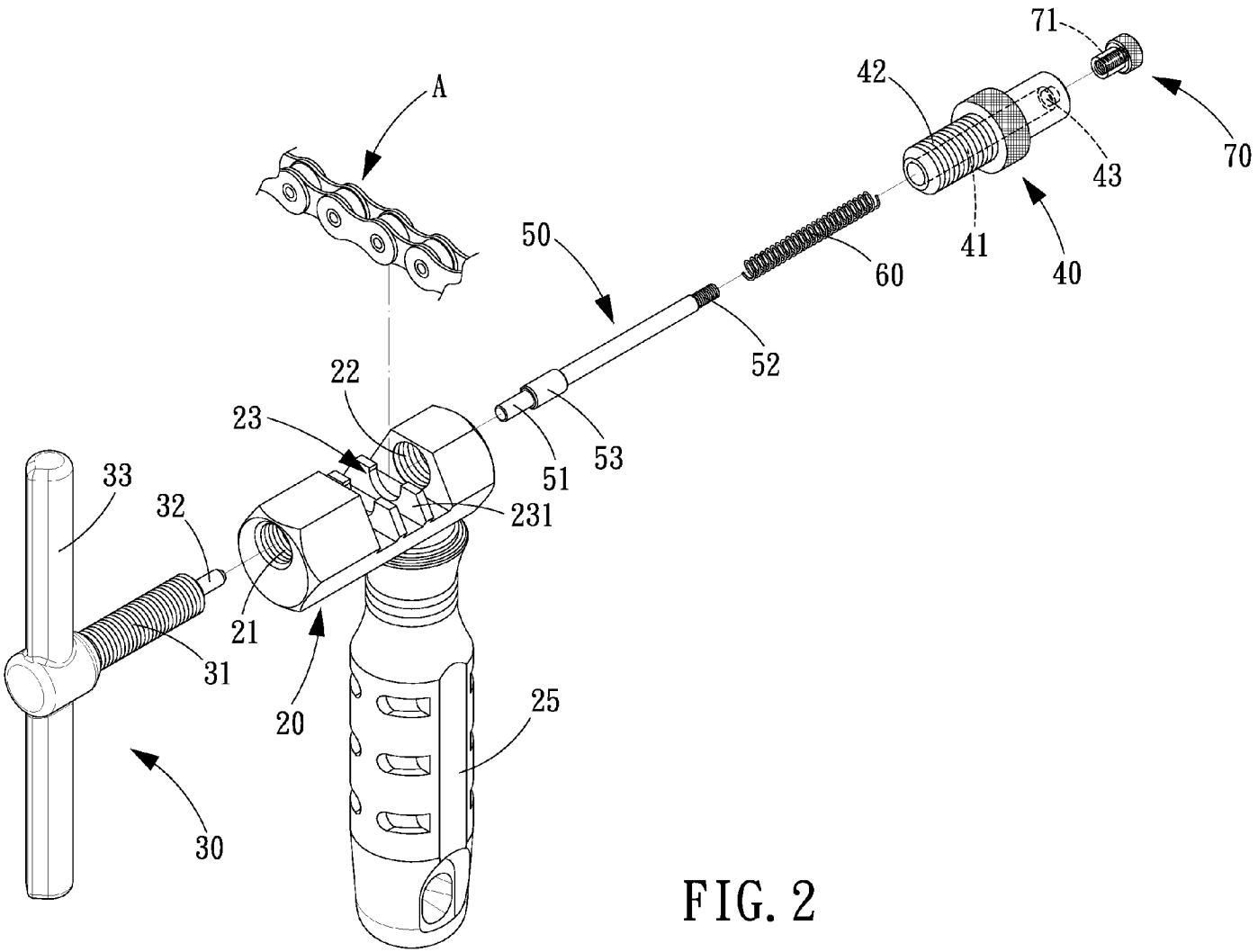
FIG. 2 is an exploded view of a device for assembling and disassembling a bicycle chain in accordance with the present invention.
Figure 3:
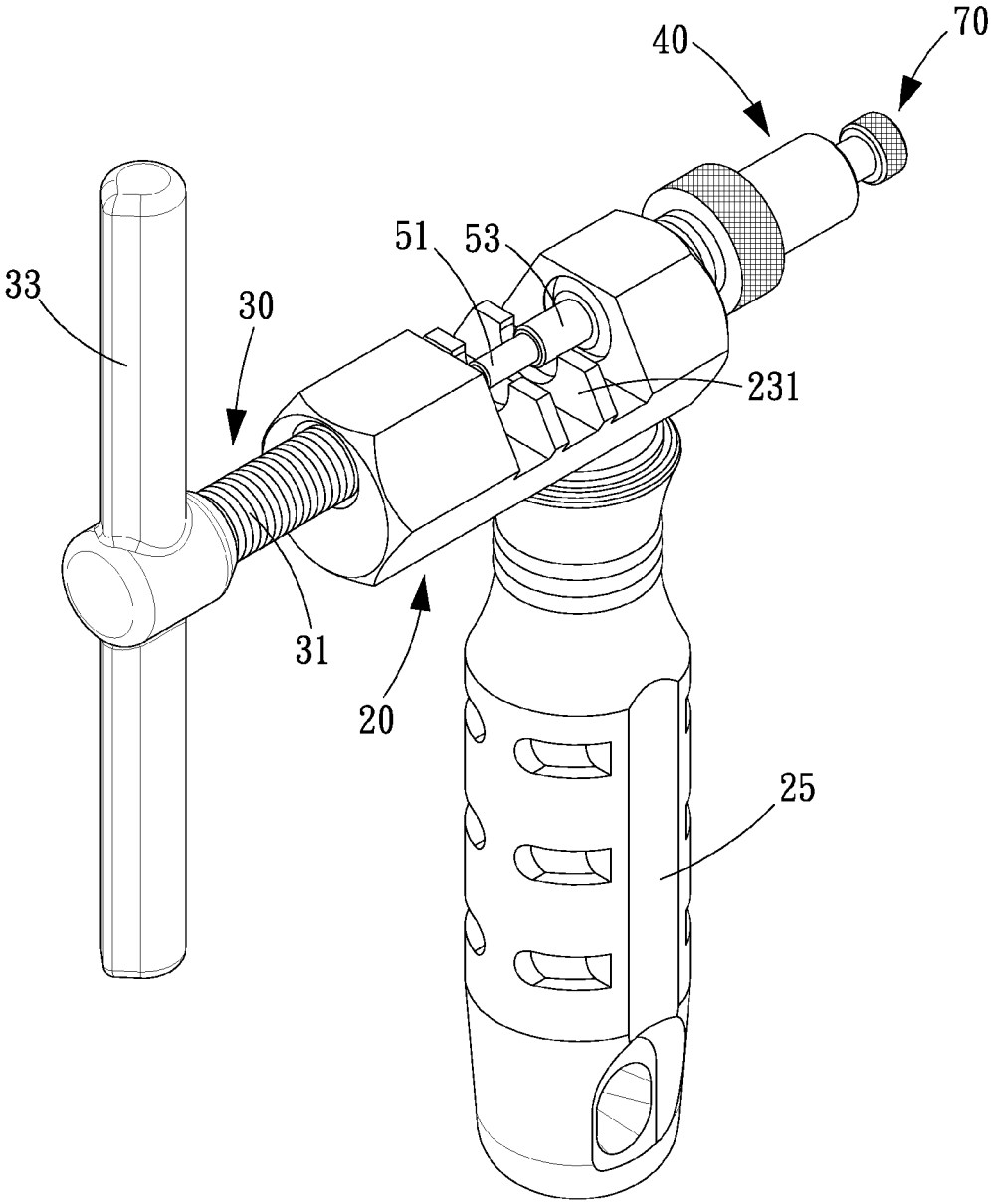
FIG. 3 is an assembly view of the device for assembling and disassembling a bicycle chain in accordance with the present invention.
Figure 4:
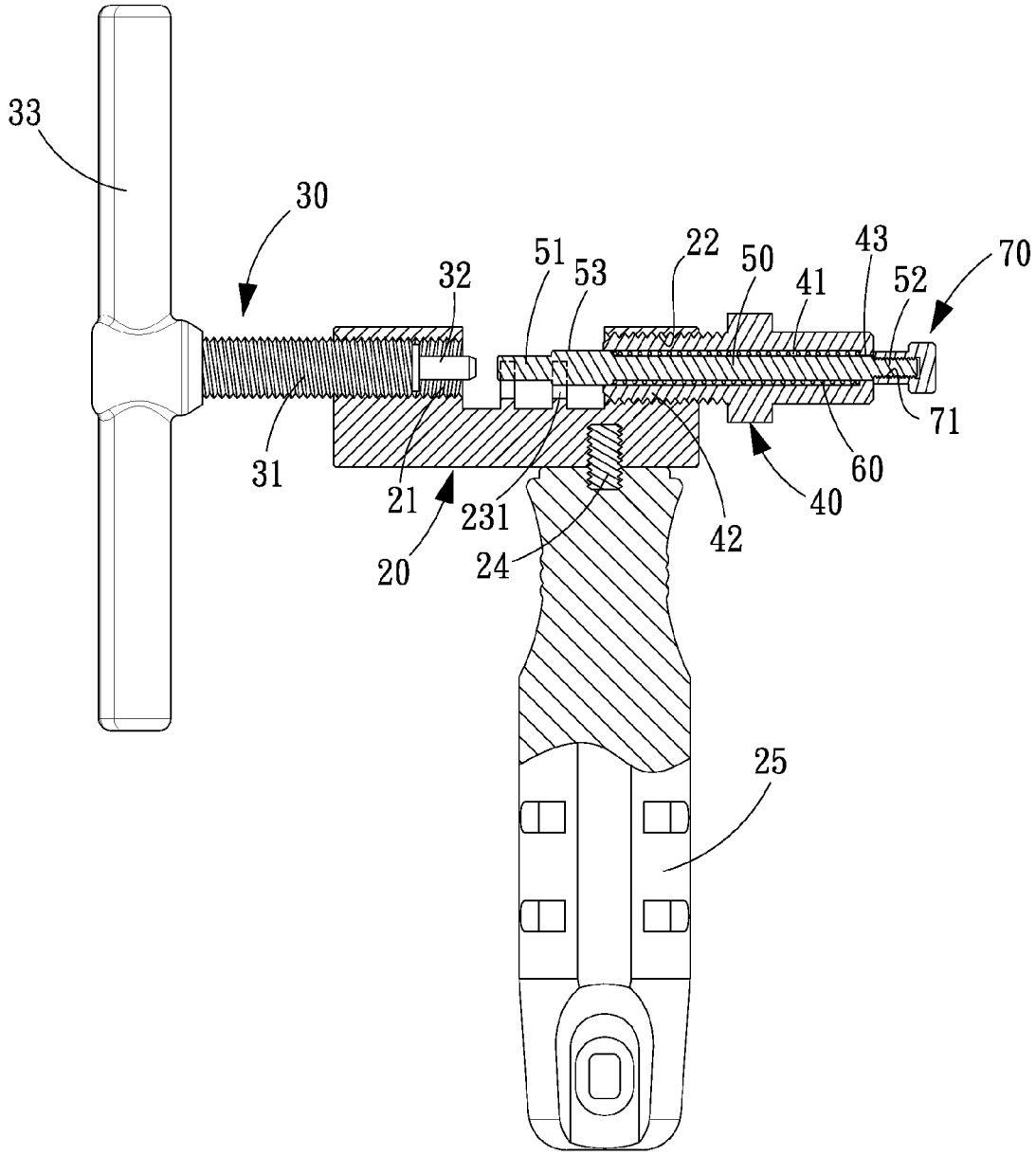
FIG. 4 is a cross-sectional view of the device for assembling and disassembling a bicycle chain in accordance with the present invention.

Referring to FIGS. 2-4, a device for assembling and disassembling a bicycle chain in accordance with the present invention comprises a mounting seat 20, an actuating member 30, an assembling member 40, a rod member 50, a spring 60, and a pulling member 70.

The mounting seat 20 includes a threaded hole 21 and an assembling hole 22 that are coaxially arranged. The assembling hole 22 is provided with inner thread. An assembling space 23 is defined between the threaded hole 21 and the assembling hole 22, and in the assembling space 23 is formed a positioning protrusion 231 for engaging with and positioning a chain A. A handle 25 is fixed to the lower end of the mounting seat 20 by a threaded element 24.

The actuating member 30 is T-shaped and includes a threaded portion 31 to be screwed into the threaded hole 21. One end of the threaded portion 31 is pivotally connected with a pushing member 32. The pushing member 32 is located in the threaded hole 21 or the assembling space 23. The other end of the threaded portion 31 includes an operating portion 33 for controlling the threaded portion 31 to drive the pushing member 32 to move toward or backward from the assembling hole 22 of the mounting seat 20.

The assembling member 40 is provided with an inserting hole 41 and an assembling portion 42 at one end of the inserting hole 41. The assembling portion 42 is provided with an outer thread to be screwed in the assembling hole 22. Formed at another end of the inserting hole 41 is annular flange 43.

The rod member 50 has an outer diameter smaller than the inner diameter of the inserting hole 41 of the assembling member 40 and is movably inserted in the inserting hole 41 of the assembling member 40. The rod member 50 includes a guiding portion 51 formed at one end thereof, and the guiding portion 51 is inserted in the inserting hole 41 or the assembling space 23 in such a manner that another end 52 of the rod member 50 extends out of the inserting hole 41. The end 52 is provided with an outer threaded portion. Between the end 52 and the guiding portion 51 is a limiting portion 53 with an outer diameter smaller than the inner diameter of the inserting hole 41 but larger than the outer diameter of the rod member 50.

The spring 60 is a compression spring mounted on the rod member 50 in such a manner that both ends of the spring 60 are abutted against the limiting portion 53 of the rod member 50 and the annular flange 43 of the assembling member 40.

The pulling member 70 is disposed at the end 52 of the rod member 50 and rested against the end of the inserting hole 41 of the assembling member 40. The pulling member 70 is formed with a threaded hole 71 for engaging with the threaded portion of the rod member 50.

For a better understanding of the present invention, reference should be made to FIGS. 4-9, wherein FIG. 4 shows a non-operating state of the device for assembling and disassembling a bicycle chain.

Figure 5:
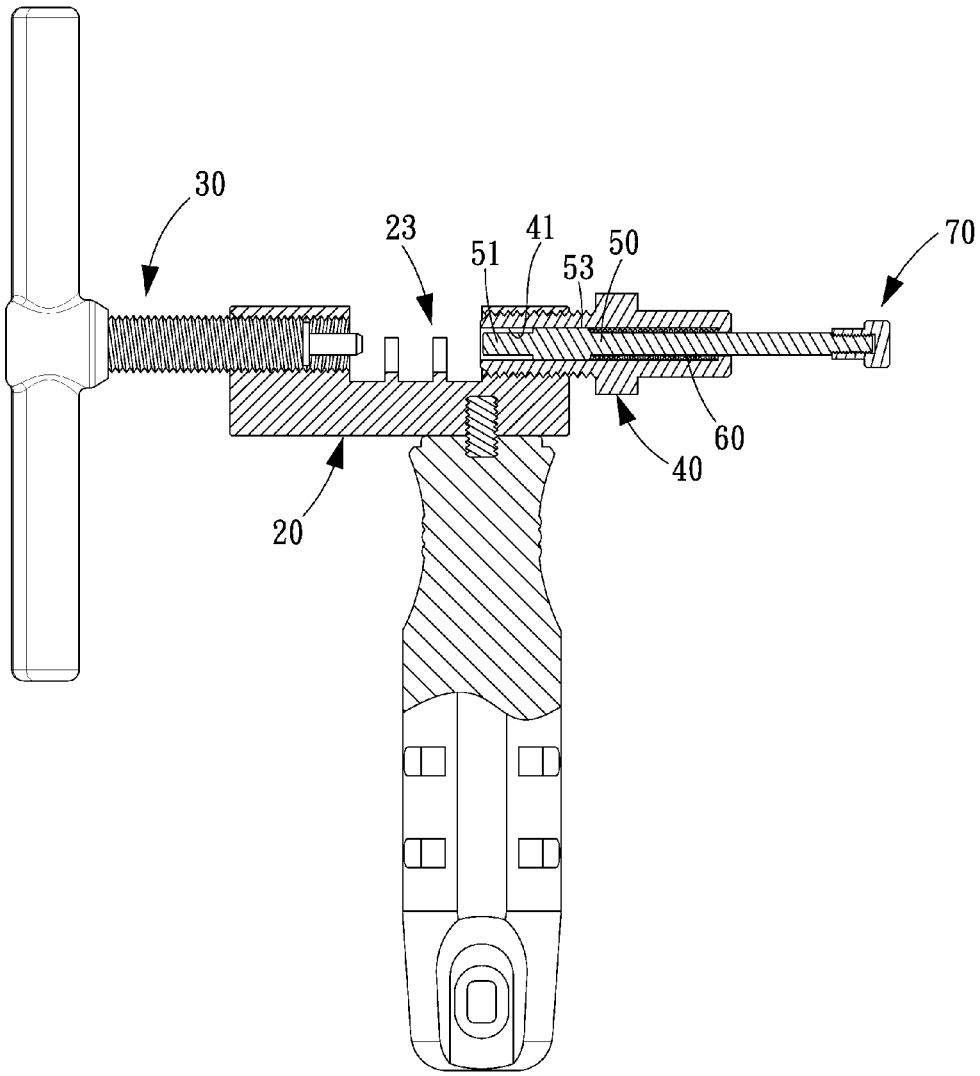
FIG. 5 is an operational view for assembling two chains, showing that the rod member is located at a position ready for assembling the chains.

To assemble the chain, as shown in FIG. 5, the pulling member 70 is pulled right so that the guiding portion 51 of the rod member 50 is moved back from the assembling space 23 of the mounting seat 20 into the inserting hole 41 of the assembling member 40, meanwhile, the spring 60 is compressed by the rod member 50.

Figure 6:
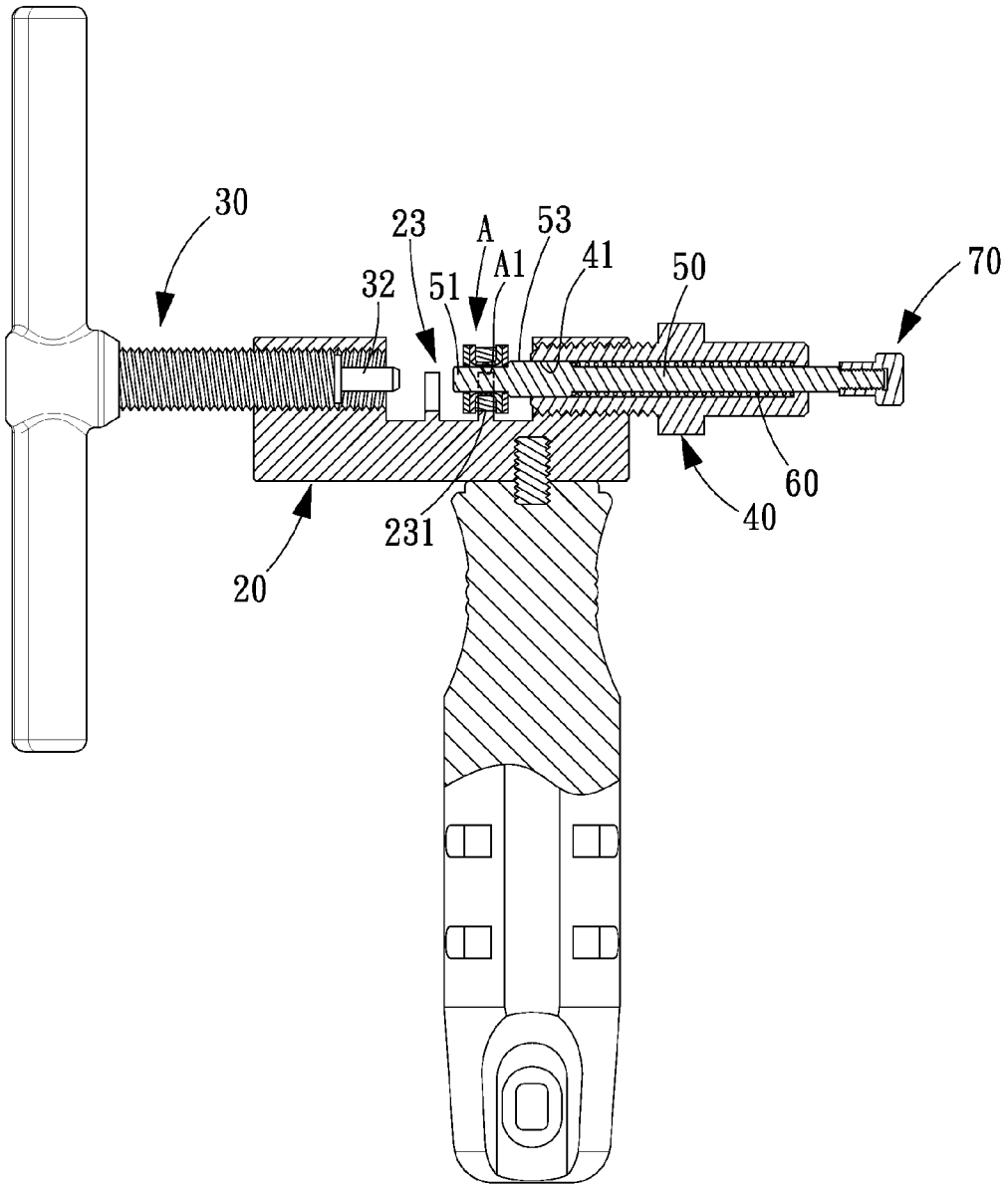
FIG. 6 is an operational view for assembling the two chains, showing that the chains are disposed in the assembling seat and pre-positioned by the rod member in accordance with the present invention.

Referring then to FIG. 6, after that, two to-be-assembled chains A are engaged on the positioning protrusion 231 of the assembling space 23, the pulling member 70 is released, and the guiding portion 51 of the rod member 50 is pushed by the spring 60 back into the assembling space 23 of the mounting seat 20. Meanwhile, the guiding portion 51 is inserted between the assembling holes A1 of the two chains A to position the two chains A.

Figure 7:
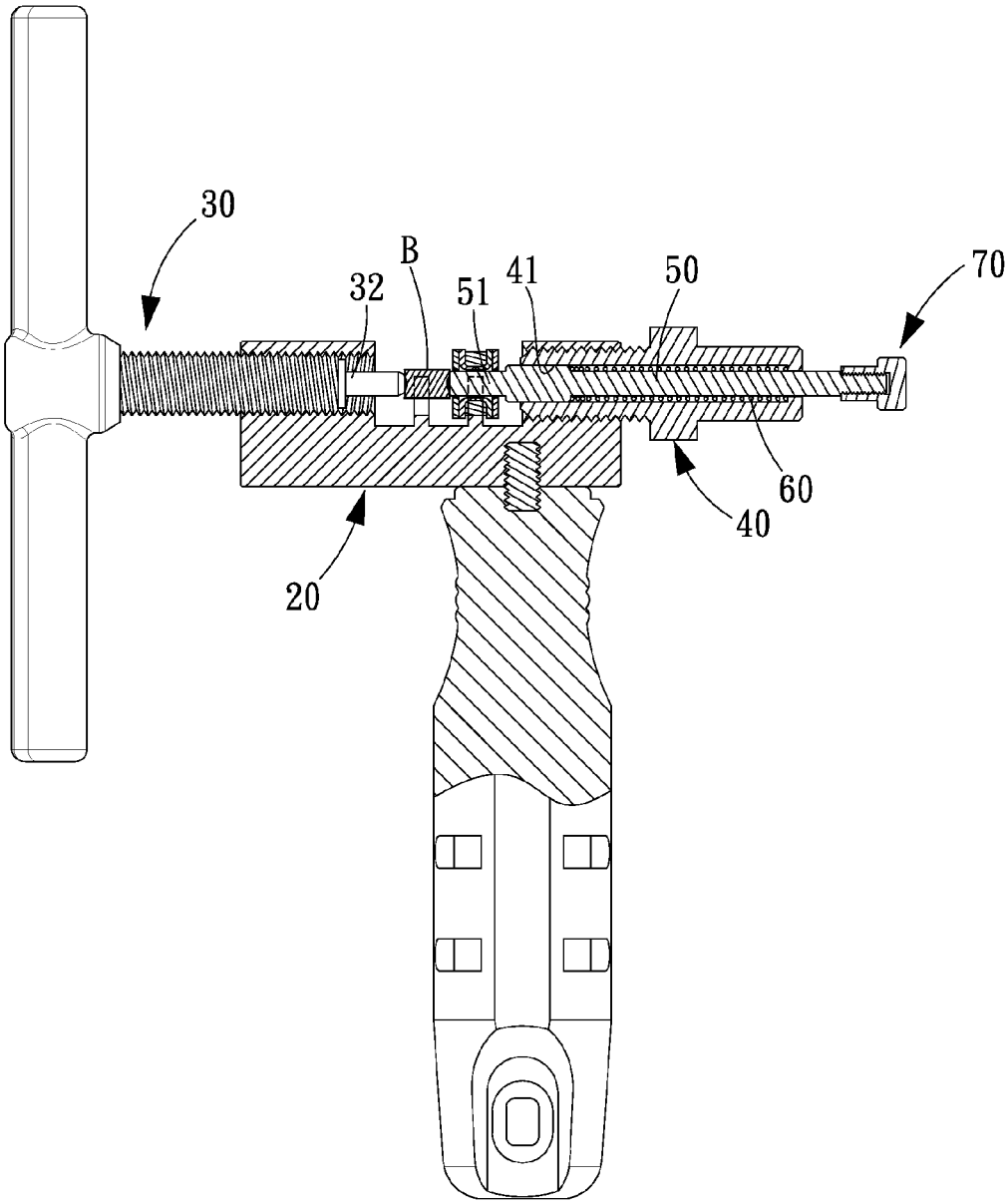
FIG. 7 is an operational view for assembling the two chains, showing a positioning member is located between an actuating member and the rod member in accordance with the present invention.

After that, referring to FIG. 7, a positioning member B will be placed between the guiding portion 51 of the rod member 50 and the pushing member 32 of the actuating member 30 in such a manner that both ends of the positioning member B are pushed against by the pushing member 32 and the guiding portion 51 to keep balance.

Figure 8:
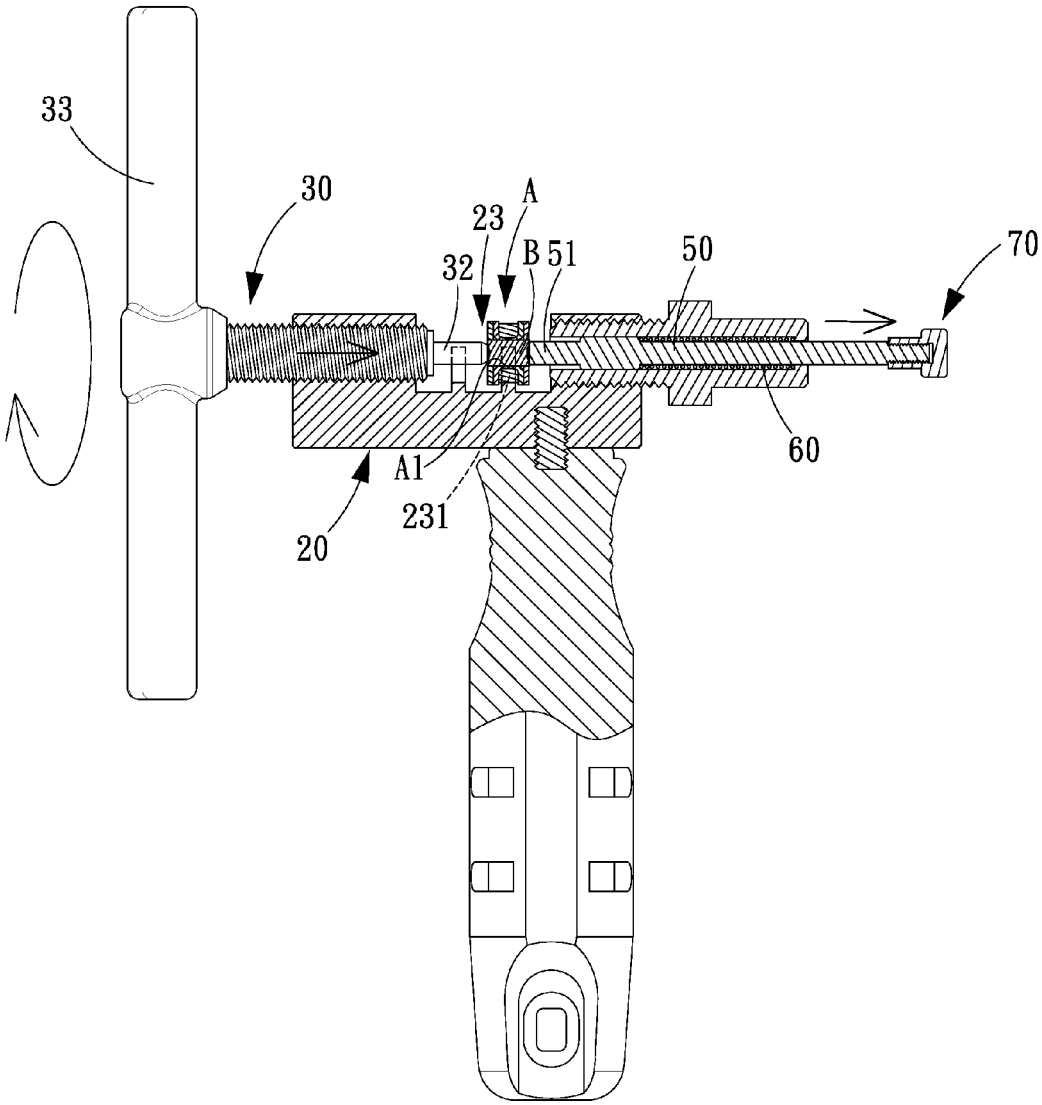
FIG. 8 is an operational view of the chain assembling/disassembling operation in accordance with the present invention, showing that the positioning member is located in the chain.

Finally, referring to FIG. 8, the operating portion 33 of the actuating member 30 is rotated to make the positioning member B and the rod member 50 move right, and as a result, the positioning member B is gradually inserted into the assembling holes A1 of the two chains A, and when the positioning member B is completely inserted into the assembling holes A1 of the two chains A, the two chains A are assembled together, namely, the chain assembly is finished.

Hence, the present invention not only can pre-insert the guiding portion 51 of the rod member 50 into the assembling holes A1 of the two chains A to pre-position it, but can apply a pushing force to the positioning member B with the help of the spring 60 to balance the positioning member B when it is ready for assembly, so that when in assembly, the user can hold the handle 25 with one hand and rotate the operating portion 33 of the actuating member 30 with the other, thus making the assembly of the bicycle chain more convenient and simple.

It is to be noted that, the device of the present invention can also be used to disassemble a bicycle chain, and the difference between the chain assembling method and the chain disassembling method is described as follows.

Referring to FIG. 8, when a chain A is engaged on the positioning protrusion 231 of the assembling space 23 of the mounting seat 20, and the pulling member 70 is released, the rod member 50 will be pushed by the spring 60 to make the guiding portion 51 push against one end of the positioning member B.

Figure 9:
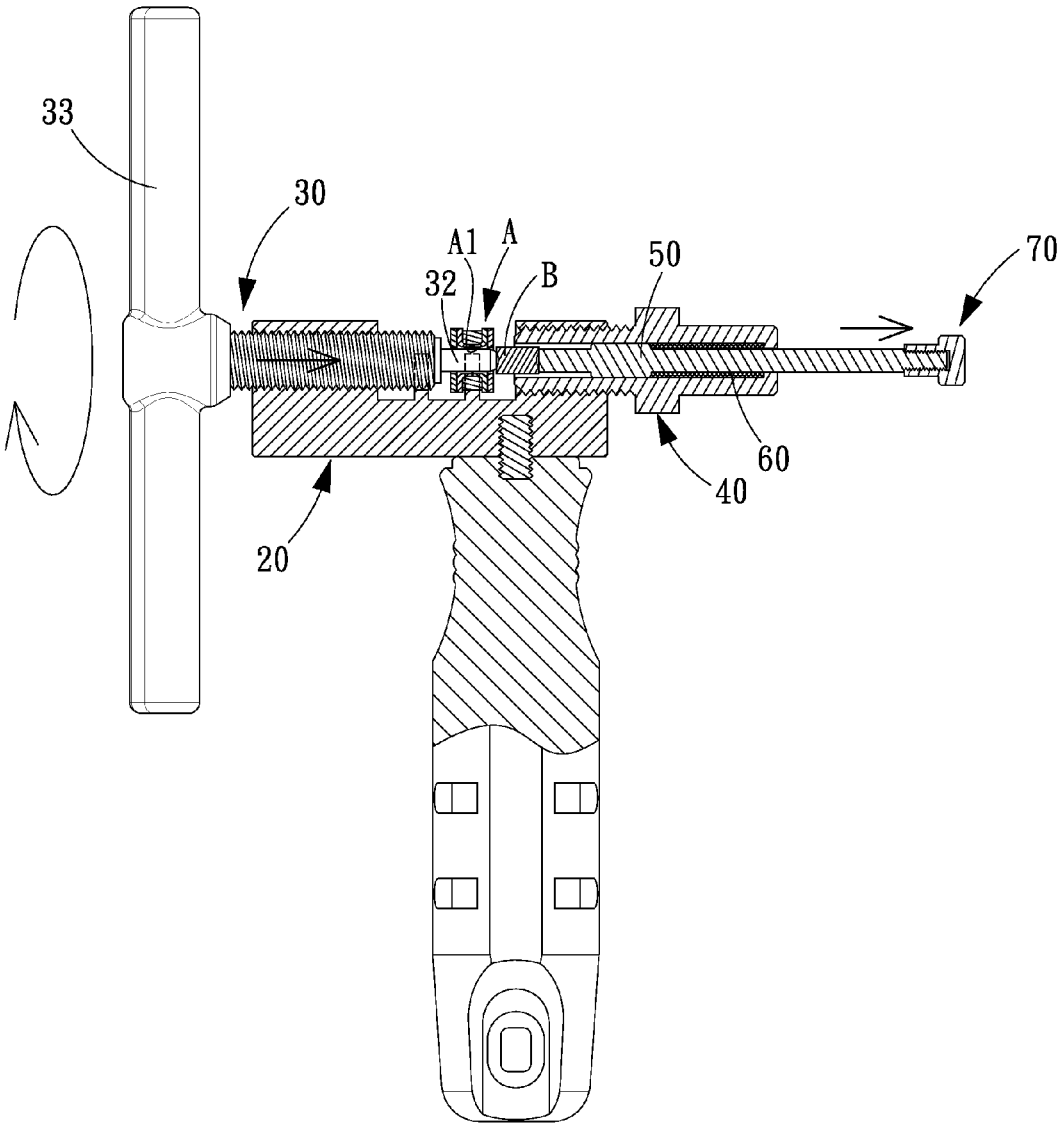
FIG. 9 is an operational view of the chain disassembling operation in accordance with the present invention, showing that the positioning member disengages from the chain.

Referring to FIG. 9, then, the operating portion 33 of the actuating member 30 is rotated to make the pushing member 32 move right, and the pushing member 32 will push the positioning member B to disengage from the assembling holes A1 of the chain A, and the positioning member B will synchronously push the rod member 50 to move right. When the positioning member B completely disengages from the assembling holes A1 of the chain A, the two chains A are disconnected, namely, the disassembly of the chain A will be finished.

While we have shown and described various embodiments in accordance with the present invention, it is clear to those skilled in the art that further embodiments may be made without departing from the scope of the present invention.

What is claimed is:

1. A device for assembling and disassembling a bicycle chain comprising:

a mounting seat including a threaded hole, an assembling hole and an assembling space between the threaded hole and the assembling hole;

an actuating member screwed in the threaded hole of the mounting seat;

an assembling member provided with an inserting hole and an assembling portion formed at one end of the inserting hole, and at another end of the inserting hole being formed an annular flange;

a rod member inserted in the inserting hole of the assembling member and having a guiding portion formed at one end thereof, and the guiding portion being inserted in the inserting hole of the assembling member or the assembling space in such a manner that another end of the rod member extends out of the inserting hole of the assembling member, and between the another end of the rod member and the guiding portion being formed a limiting portion;

a spring mounted on the rod member in such a manner that both ends of the spring are abutted against the limiting portion of the rod member and the annular flange of the assembling member; and a pulling member disposed at the another end of the rod member and rested against one end of the inserting hole of the assembling member.

2. The device for assembling and disassembling a bicycle chain as claimed in claim 1, wherein the rod member has an outer diameter smaller than an inner diameter of the inserting hole of the assembling member, the limiting portion of the rod member has an outer diameter smaller than the inner diameter of the inserting hole of the assembling member but larger than the outer diameter of the rod member.

3. The device for assembling and disassembling a bicycle chain as claimed in claim 1, wherein the rod member is provided at the anther end thereof with an outer threaded portion, and the pulling member is formed with a threaded hole for engaging with the outer threaded portion of the rod member.

4. The device for assembling and disassembling a bicycle chain as claimed in claim 1, wherein the assembling portion of the assembling member is screwed in the assembling hole of the mounting seat.

5. The device for assembling and disassembling a bicycle chain as claimed in claim 1, wherein a handle is fixed to the mounting seat.

6. The device for assembling and disassembling a bicycle chain as claimed in claim 1, wherein the actuating member includes a threaded portion to be screwed into the threaded hole, one end of the threaded portion of the actuating member is pivotally connected with a pushing member which is located in the threaded hole or the assembling space of the mounting seat, and another end of the threaded portion of the actuating member includes an operating portion.

* * * * *